United States Patent [19]

Höll et al.

[11] 4,271,730

[45] Jun. 9, 1981

[54] WRENCHING DEVICE FOR INSTALLING AND TIGHTENING SCREWS TO A HIGH TORQUE

[75] Inventors: Alfred Höll, Niederroth; Anton Wewerka, Dachau, both of Fed. Rep. of Germany

[73] Assignee: Maschinenfabrik Augsburg-Nurnberg Aktiengesellschaft, Fed. Rep. of Germany

[21] Appl. No.: 55,773

[22] Filed: Jul. 9, 1979

[30] Foreign Application Priority Data

Jul. 13, 1978 [DE] Fed. Rep. of Germany ..... 2830906

[51] Int. Cl.[3] ..... B25B 29/00

[52] U.S. Cl. ..... 81/57.4; 81/57.24; 105/148

[58] Field of Search ..... 81/57.4, 57.41, 57.24, 81/57.25, 57.35; 105/148

[56] References Cited

U.S. PATENT DOCUMENTS

| | | | |
|---|---|---|---|
| 2,212,696 | 8/1940 | Nash | 105/148 |
| 2,582,442 | 1/1952 | Lapp | 81/57.24 |
| 3,491,427 | 1/1970 | Zimnerman et al. | 81/57.24 |

*Primary Examiner*—James L. Jones, Jr.

*Attorney, Agent, or Firm*—Scully, Scott, Murphy & Presser

[57] ABSTRACT

Wrenching or torquing device for installing and tightening screws to a higher torque through a torque-type power wrench attached to the lower end of an extensible telescope strut. The strut travels along an overhead rail through the intermediary of a roller tram. The power wrench is attached to the telescope strut so that the reaction torque of the wrench is transmitted to the telescope strut in the form of an axial or transverse force.

11 Claims, 4 Drawing Figures

WRENCHING DEVICE FOR INSTALLING AND TIGHTENING SCREWS TO A HIGH TORQUE

BACKGROUND OF THE INVENTION

1. Field of the Invention

The present invention relates to a torquing or wrenching arrangement for the installing and tightening of screws at a high torque.

2. Discussion of the Prior Art

A wrenching arrangement of that type has been disclosed in U.S. Pat. No. 2,212,696. This earlier wrenching arrangement utilizes a so-called straight wrench which is attached to the lower end of a telescope support strut whereby the screw axis extends parallel to the longitudinal axis of the telescope support strut. This causes the reaction torque of the wrench to be transferred to the telescope support strut as a torsional moment or torque relative to the longitudinal axis of the telescope support strut. In order to absorb the torsional torque, the telescope support strut is imparted a multiple-edged section, as shown in FIG. 3 of the drawing of the patent. The primary drawback of this prior art device lies in that the reaction torque or moment of the wrench must be transferred as torsional moment over the entire length of the telescope support strut, so that the telescope support strut must of necessity exhibit an accordingly high resistance to torsion, which causes the telescope support strut to assume an undesirably heavy construction.

Heretofore, screws requiring a high installation torque were tightened with so-called striker-power wrenches. Due to the striking movement of these tools during the tightening of the screws, a relatively small amount of torque is sufficient for tightening the screw, so that the above-described manner of attaching the striker-type power wrench to a telescope support strut is still feasible, considering the resistance of the telescope support strut to torsion. Striker-type power wrenches are nevertheless subject to the considerable disadvantage in that the striking movement generates extensive noise, particularly when the screws must be installed in large, metal elements acting as resonant bodies. Such large metal elements are, for instance, chassis for trucks. Inasmuch as during the manufacture of such large element several screws must be tightened simultaneously, the noise generated by this tool often increases to a level where it becomes a health hazard.

SUMMARY OF THE INVENTION

Accordingly, it is a primary object of the present invention to provide a wrenching arrangement of the broad type described which, during operation, generates only a minimal noise, which is simple to manipulate, and which, moreover, can be effectuated with little complexity in construction.

It is an object of the present invention to provide a wrenching arrangement for installing and tightening screws to a high torque using a power wrench attached to the lower end of an extensible telescope strut which, in turn, is allowed to travel along an overhead rail by means of a roller tram, and in which the power wrench is a torque-type angular power wrench, the power wrench being attached to the telescope strut whereby the reaction torque of the wrench is transmitted to the telescope strut in the form of an axial or transverse force.

The use of a torque-type wrench in lieu of a striker wrench will eliminate the development of noise during the tightening process. Moreover, the desired installation torque is adjusted much more precisely than with a striker wrench. The resulting reaction moment, which equals the required installation torque, is transferred in the form of axially directed tension or compression or as a bending moment to the telescope strut through the construction of the power wrench as an angular power wrench and suitable attachment thereof to the telescope strut. This facilitates a light-weight construction of the telescope strut, with the resultant advantages relative to manipulation and manufacturing costs.

In a preferred embodiment of the present invention, the shank of the power wrench extends at approximately right angles to the telescope strut and is supported by the telescope strut at at least one location remote from the screwing axis, wherein the telescope strut includes a clamping device for the fixing of its length. In this arrangement, the reaction moment produced when a screw is being tightened is transmitted, due to the horizontal disposition of the power wrench, in the form of longitudinal force, into the telescope strut so that there must be provided a clamping device for the telescope strut.

In another preferred embodiment of the present invention, the shank of the power wrench extends parallel relative to the telescope strut and a blocking device is provided for the roller tram. In this position of the power wrench the reaction moment produced when a screw is being tightened is transmitted to the telescope strut in the form of a transverse force running at right angles to, but also in the direction of the overhead rail, depending upon the orientation of the screwing or wrenching axis. When the screwing axis extends perpendicular to the direction of the overhead rail, a transverse force is produced in the telescope strut which extends in the direction of the overhead rail, so that it would be advantageous to provide an arresting device for the roller tram to prevent the telescope strut from rolling away under the reaction produced when a screw is being tightened. Above all, the braking forces which must be explained by the arresting device on the roller tram are, as a rule, quite low since the distance from the overhead rail to the screwing axis consists of several meters. In the case in which the shank of the power wrench is directed parallel to the telescope strut, there can be omitted a clamping device for the telescope strut itself since there will then be practically no transfer of longitudinal forces from the telescope strut.

In another preferred embodiment of the present invention, a control unit is provided for the clamping device and/or the arresting device, the control unit being coupled to the power wrench drive switch. Through such a coupling there is achieved that when a reaction torque or moment is encountered, in essence, when the power wrench drive is on, this will be absorbed either by the clamping device or the arresting device.

In a further feature of the present invention, the coupling between the power wrench drive switch and the control unit is so designed that the power wrench can be driven only at an actuated clamping or arresting. This will ensure that the wrenching device is fixed with regard to reaction moment before effecting a screwing movement, so that, even at the commencing of the screwing movement, an unforeseen resistance cannot lead to an uncontrolled reaction movement of the wrenching device.

It is particularly advantageous that when the power wrench is driven by compressed air, at compressed air drive the deactuating torque is easily adjustable and that operating shocks can be prevented during compressed air operation.

In a further aspect of the present invention there is arranged a weight balancing device in the form of a gas cushion within the telescope strut. Employing a gas cushion as a weight balancing device affords the advantage in that the desired operating level for the wrenching device, or an upwardly directed restoring force, can be easily adjusted so that the power wrench to be slowly upwards pulled after completion of the work.

Finally, another advantage of the present invention resides in that the clamping and/or arresting devices are pneumatically operated devices and wherein also the control for actuating the clamping and arresting devices is a pneumatic control. This permits the entire wrenching device to be operated on compressed air as the exclusive operating medium, which renders it particularly suitable for use in workshops.

BRIEF DESCRIPTION OF THE DRAWINGS

Reference may now be had to preferred embodiments of the present invention described more fully hereinbelow in conjunction with the accompanying drawings; in which.

DETAILED DESCRIPTION

Figure 1:
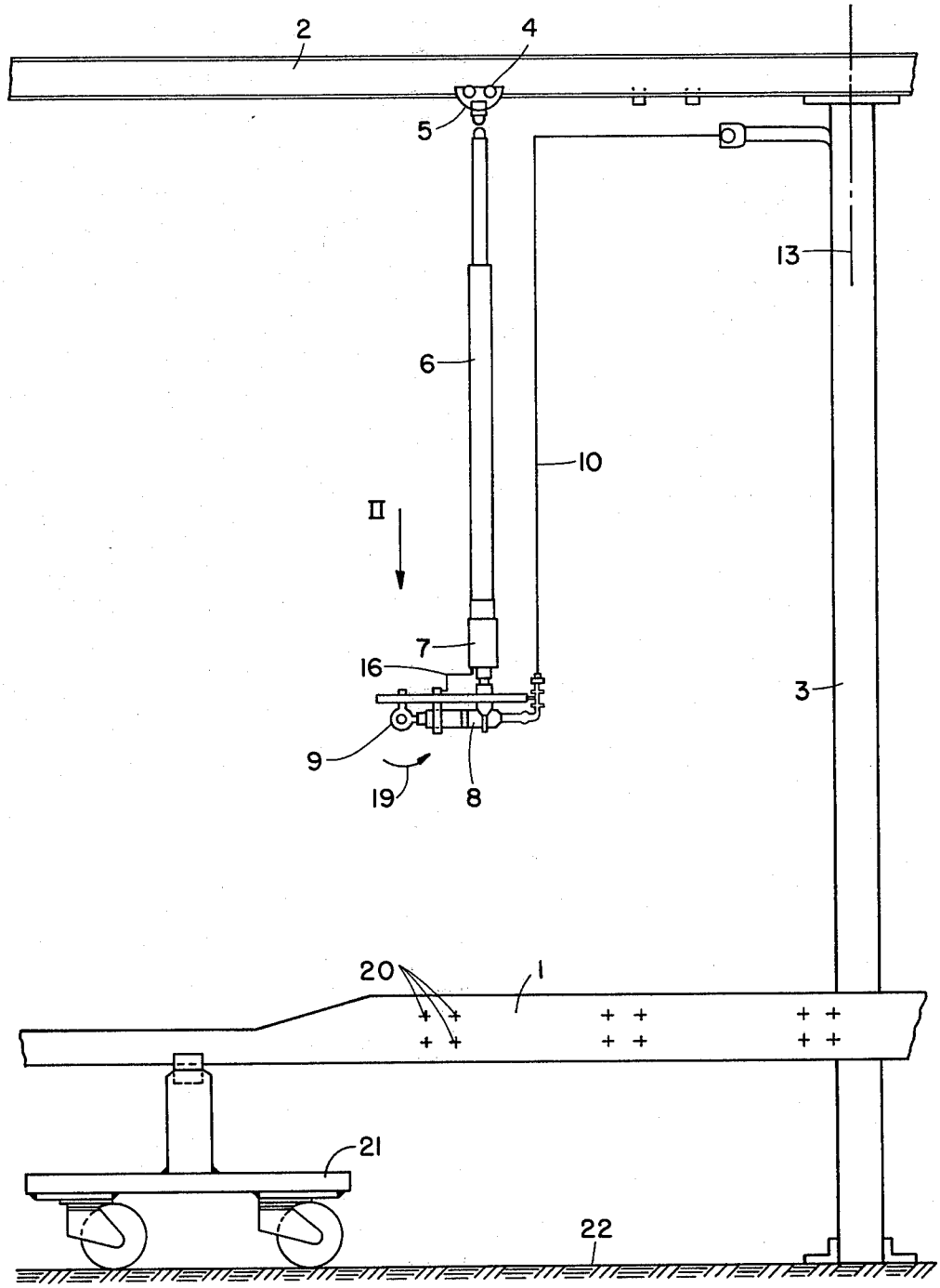
FIG. 1 schematically shows a general arrangement of a wrenching device in a factory.

FIG. 1 is a side elevational view illustrating a vehicle chassis 1 which is supported on an assembly cart 21. The assembly cart 21 rests on the floor 22 of an assembly shop. Concurrently supported on the floor 22 of the assembly shop is a column 3 which eventually together with others, carries an overhead rail 2. The overhead rail 2 may also be fastened for pivotal movement on the column 3 as is indicated by the pivot axis 13. Traveling on the overhead rail 2 is a tram 4 on which there is suspended an extendable telescope strut 6. Arranged in the telescope strut 6 is a gas cushion (not shown) forming a weight balancing arrangement. Attached to the lower end of the telescope strut 6 is an angular torque-type power wrench 8. The screwing or torquing axis of the angular wrench is identified by the numeral 9 and, as is apparent from FIG. 1, the angular wrench 8 extends at right angles to the telescope strut 6 and attaches to the telescope strut 6 at a point lying remote from the screwing axis 9. The angular wrench 8 is a pneumatic tool which is supplied with compressed air through a pressurized air line 10. Provided at the lower end of the telescope strut 6 is a clamping device 7 which is also operated by compressed air. For this purpose, and for a simultaneously or alternatively provided arresting device 5 in the tram 4 for the arresting of the tram 4 on the overhead rail 2, a further pressurized air line 16 leads from the angular wrench 8 to the clamping device 7 and, if necessary, from there to the arresting device 5. The wrenching device illustrated serves to install and tighten screws, the centerlines of which are identified by the numeral 20, in the chassis 1. In this arrangement, the direction of the screwing or torquing movement is counter-clockwise as shown on the drawing by the arrowhead 19, because the screwing device is viewed herein as lying behind the chassis 1. Before the screw is installed and tightened, the angular wrench 8 is pulled down by extending the telescope strut 6 until the screwing axis 9 is coincident with one of the screw axes in the chassis 1, and the wrench tool can be seated over the head of the screw. At the actuation of a switch for the wrench (12 in FIG. 2) the clamping device 7 is initially actuated, and thereafter the wrench drive is actuated. In this manner the reaction moment produced upon the tightening of the screw can be absorbed as tension by the telescope strut 6 and transmitted into the overhead rail 2.

Figure 2:
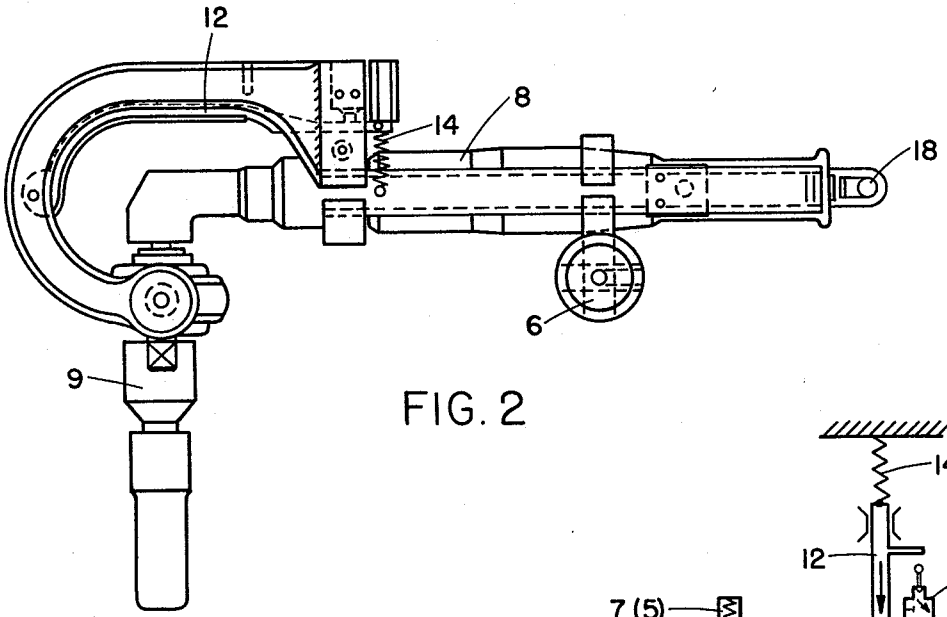
FIG. 2 is a plan view of the wrenching device in the direction of arrow II in FIG. 1.

FIG. 2 is an enlarged top plan view of the angular wrench 8 of FIG. 1. The same parts are identified herein by the same numerals as in FIG. 1. Arranged at the rear end of the angular wrench 8 is a compressed air connection 28 to which there is connected the compressed air supply line 10. The switch 12 is held in its neutral position by a return spring 14 and will remain in its operating position only for so long as it is manually actuated.

Figure 4:
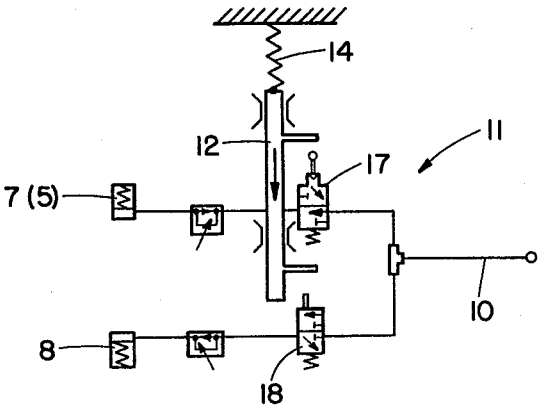
FIG. 4 is a schematic arrangement of the control for the wrenching devices of FIGS. 1 to 3.

FIG. 4 is a schematic representation of the control for the wrench drive and the clamping device 7. For reasons of clarity, the simply drawn switch 12 is shown here as a control rod, the operating movement of which is viewed in the direction of the arrow. This switch 12 is coupled to a control device which in its entirety is identified by the numeral 11 and in effect so that the upper cam of the switch 12 upon actuation of the switch 12 will first actuate a pneumatic control valve 17 for the clamping device 7 before the lower cam of the switch 12 actuates a pneumatic control valve 18 for the drive unit of the angular wrench 8. This control ensures that when the drive of the angular wrench 8 is switched on, the wrenching device will be supported gainst reaction torques or moments resulting from the torquing or screwing movement.

Figure 3:
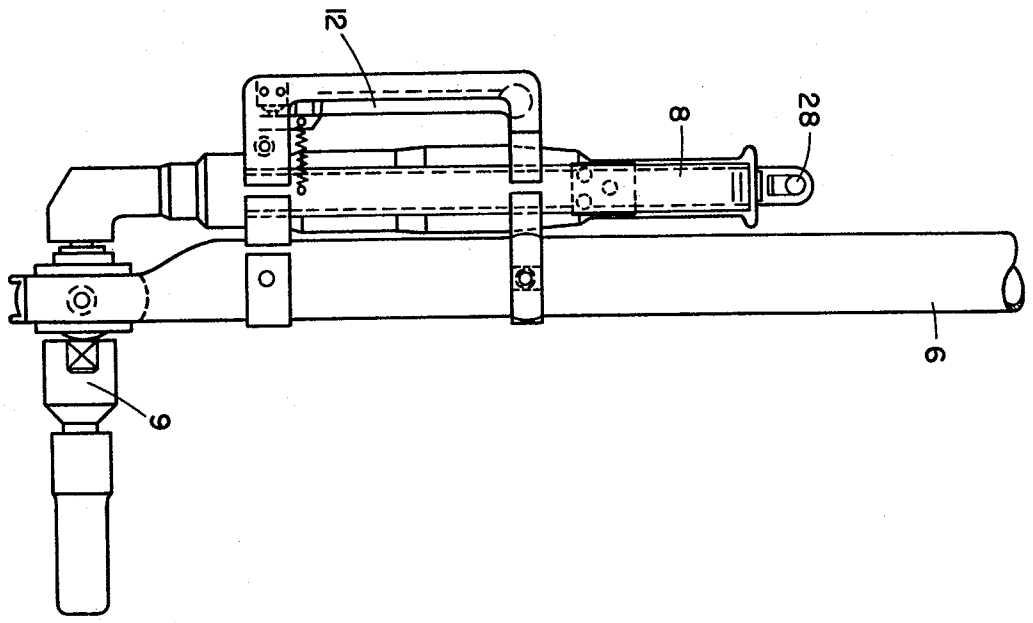
FIG. 3 is an alternative embodiment of the wrenching device of the present invention shown in a fragmentary lateral view.

The arresting device 5 can alternatively be actuated in lieu of the clamping device 7 in FIG. 4, which is particularly the case when the angular wrench is arranged on the telescope strut 6 as shown in FIG. 3. In this embodiment of the inventive wrenching device, the shank of the angular wrench 8 extends in parallel with the telescope strut 6. When the angular wrench 8 is hereby so oriented that the screwing axis 9 points in the direction of the overhead rail 2, no clamping or arresting action is required to absorb reaction torques because the reaction torques can readily be absorbed by overhead rail as a transverse force acting at right angles to the overhead rail 2 through the rollers of the tram 4. However, when the screwing axis 9 extends perpendicular to the direction of the overhead rail 2, it is necessary to operate the arresting device 5 for the tram 4 since otherwise the tram 4 will travel along the overhead rail 2 under the occurence of a reaction moment on the angular wrench 8. The rolling away of the tram 4 under the reaction torque can above all be eliminated or held within narrow bounds however, by providing a clamping device 7 on the telescope strut 6 as shown in the embodiment of FIG. 2, with this device preventing extension of the telescope strut and thus also holding a lateral displacement of the tram 4 within narrow bounds.

What is claimed is:

1. In a wrenching or torquing device for installing and tightening screws to a high torque; a power wrench; an extensible telescope strut, said wrench being attached to the lower end of said telescope strut; an overhead rail; a roller tram adapted to travel along said rail, said strut being suspended from said tram, the improvement comprising: said telescope strut being a tubular member, said power wrench being a torque-type angular power wrench, said power wrench being attached to the telescope strut in an adjacent mounting and having a shank extending approximately at a right angle to the telescope strut and being supported on the telescope strut at at least one point lying remote from the screwing axis such that the reaction torque of the wrench is transmitted to the telescope strut as an axial or transverse force.

2. Device as claimed in claim 1, said power wrench having a shank extending approximately at right angles to the telescope strut and being supported on the telescope strut at at least one point lying remote from the screwing axis; and clamping means on said telescope strut for maintaining the length of the latter.

3. Device as claimed in claim 2, said shank of the power wrench extending parallel to the telescope strut; and an arresting device being provided for said roller tram.

4. Device as claimed in claim 3, comprising a control unit for said clamping means and said arresting device; said control unit being coupled to a power wrench drive switch.

5. Device as claimed in claim 4, said coupling between the switch of the power wrench drive and said control unit being actuatable such that the power wrench is driven only upon clamping by said clamping means or arresting by said arresting device.

6. Device as claimed in claim 1, comprising a compressed air drive for said power wrench.

7. Device as claimed in claim 1, comprising weight balancing means arranged in said telescope strut.

8. Device as claimed in claim 7, said weight balancing means being a gas cushion.

9. Device as claimed in claim 2, said clamping means comprising a pneumatic device.

10. Device as claimed in claim 3, said arresting device comprising a pneumatic device.

11. Device as claimed in claim 4, said control unit for operating the clamping means and the arresting device and said power wrench drive comprising pneumatic controls.

* * * * *